US005509358A

United States Patent [19]

Hawthorne et al.

[11] Patent Number: 5,509,358

[45] Date of Patent: Apr. 23, 1996

[54] RAILCAR TRUCK BEARING ADAPTER CONSTRUCTION

[75] Inventors: V. Terrey Hawthorne, Lisle; Glen F. Lazar, Palatine; Norman A. Berg, Wheaton, all of Ill.

[73] Assignee: AMSTED Industries Incorporated, Chicago, Ill.

[21] Appl. No.: 351,809

[22] Filed: Dec. 8, 1994

[51] Int. Cl.[6] ..... B61F 5/26

[52] U.S. Cl. ..... 105/218.1; 105/219; 105/225

[58] Field of Search ..... 105/206.1, 218.1, 105/219, 220, 224.1, 225

[56] References Cited

U.S. PATENT DOCUMENTS

| | | | |
|---|---|---|---|
| 2,207,848 | 7/1940 | Barrows | 105/224.1 |
| 3,211,112 | 10/1965 | Baker | 105/224.1 |
| 3,274,955 | 9/1966 | Thomas . | |
| 3,276,395 | 10/1966 | Heintzel . | |
| 3,381,629 | 5/1968 | Jones . | |
| 3,621,792 | 11/1971 | Lich . | |
| 3,699,897 | 10/1972 | Sherrick . | |
| 4,030,424 | 6/1977 | Garner et al. . | |
| 4,034,681 | 7/1977 | Neumann et al. . | |
| 4,072,112 | 2/1978 | Wiebe . | |
| 4,078,501 | 3/1978 | Neumann et al. . | |
| 4,082,043 | 4/1978 | Hammonds et al. . | |
| 4,103,623 | 8/1978 | Radwill . | |
| 4,103,624 | 8/1978 | Hammonds et al. . | |
| 4,108,080 | 8/1978 | Garner et al. . | |
| 4,192,240 | 3/1980 | Korpics . | |
| 4,242,966 | 1/1981 | Holt et al. . | |
| 4,416,203 | 11/1983 | Sherrick . | |
| 4,428,303 | 1/1984 | Tack . | |
| 4,841,875 | 6/1989 | Corsten et al. . | |

OTHER PUBLICATIONS

Car and Locomotive Cyclopedia (1974).

"Truck Hunting in the Three–Piece Freight Car Truck", by V. T. Hawthorne Aug. 1979.

*Primary Examiner*—Robert J. Oberleitner
*Assistant Examiner*—Kevin D. Rutherford
*Attorney, Agent, or Firm*—Edward J. Brosius; F. S. Gregorczyk

[57] ABSTRACT

A railcar truck side frame has a pedestal jaw arrangement, which inclines the bearing adapter for the axle and bearing assembly with a relative slope in the side-frame longitudinal direction, to provide transfer of the forces causing angular displacement of the axle to stop lugs on the side-frame outer surface and to minimize axle angular displacement and, consequently, truck warping and hunting.

9 Claims, 3 Drawing Sheets

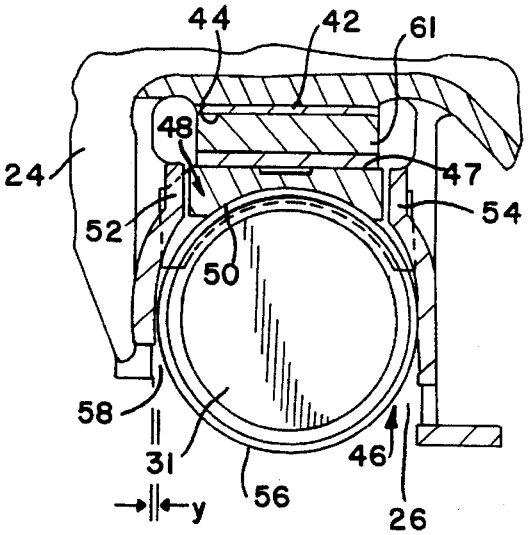
FIG. 2
PRIOR ART
FIG. 3
PRIOR ART
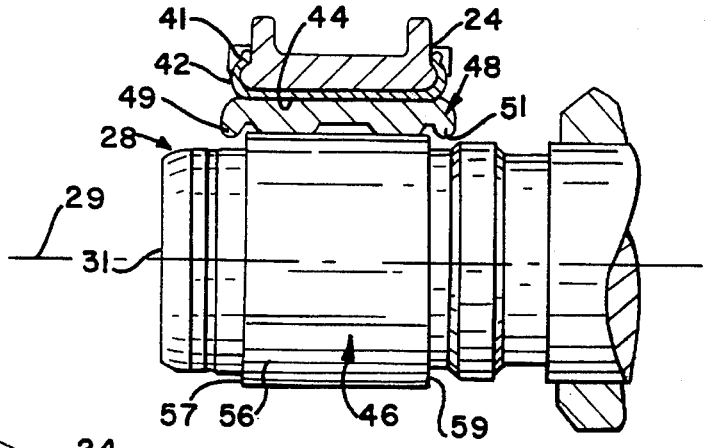
FIG. 4
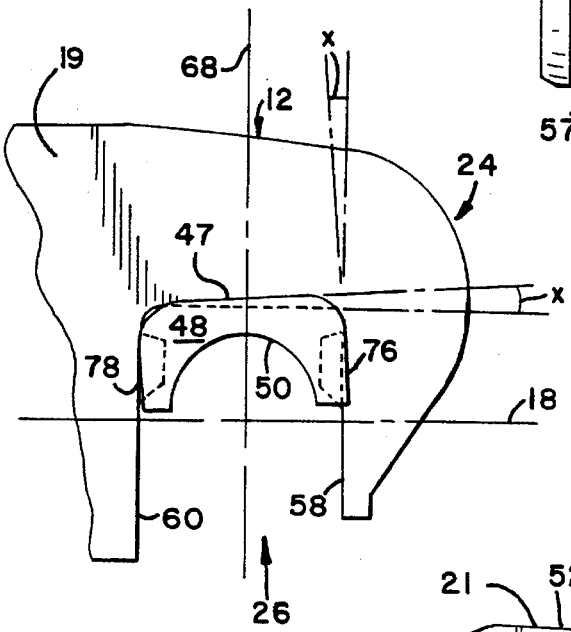
FIG. 4A
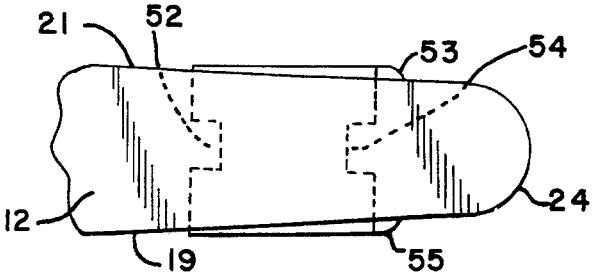

RAILCAR TRUCK BEARING ADAPTER CONSTRUCTION

BACKGROUND OF THE INVENTION

1. Field of the Invention

The present invention relates to a bearing adapter assembly for a railcar truck. More specifically, tightly secured bearing adapters firmly hold the axle bearing in position to avoid angling and lateral axle variation, and the resultant truck "warping". Past research has illustrated railcar truck warping induces truck hunting during railcar travel, which warping causes undue wear on rails and wheels as well as increasing fuel usage.

2. Description of the Prior Art

In a three-piece railcar truck assembly, the side frames and bolster are generally square, that is the axles and bolster are approximately parallel to each other, and the side frames are parallel to each other but normal to the axles and bolster. After truck assembly and at certain railcar speeds, the truck may become dynamically unstable, which may be loosely defined as truck hunting. Truck hunting is defined in the Car and Locomotive Cyclopedia (1974) as "an instability at high speed of a wheel set (truck), causing it to weave down the track, usually with the (wheel) flanges striking the rail." Truck hunting has been the subject of many past and ongoing research efforts within the rail industry by truck suppliers, car builders and railroad lines, as this condition is undesirable from both operational and safety considerations. Past research efforts have noted a significant relationship between truck warping and resultant truck hunting. These research efforts and some of their conclusions are discussed in the ASME paper, "Truck Hunting in the Three-Piece Freight Car Truck" by V. T. Hawthorne, which paper included historical reference to still earlier research in this field. One of the earlier researchers noted ". . . that in the empty car the higher column force of the constant column damping provides a greater warp stiffness and, consequently, yields a higher critical (truck) hunting speed." The ASME paper described a project that was designed to measure the following parameters: warp stiffness; lateral damping force; and, lateral spring rate.

The warp stiffness results in this Hawthorne project duplicated earlier test results and it was noted that as the warp angle increased to 1° (60 minutes) of angular displacement, the warp stiffness dropped off appreciably. Further, it was noted that earlier warp stiffness data showed that 1° of displacement represented the maximum warp travel of a relatively new truck during hunting. Therefore, at warp angles prevalent in truck hunting, the warp stiffness fell considerably below the values necessary to raise the critical speed of hunting above the normal operating range of the freight railcar.

A field test noted that a new railcar truck running at a speed above 60 miles per hour with track inputs causing warp angles below 0.3° would not be expected to hunt. However, if the warp angle suddenly became 1.0° due to a track irregularity, it is expected that the critical truck hunting speed of the railcar would drop to about 52 miles per hour and intermittent truck hunting would occur.

A three-piece railcar truck generally allows a considerable amount of relative movement between the wheel and axle assembly, or the wheelset which includes the axle, wheels and the bearings, and the supporting side frame at the side-frame pedestal jaw. This may be due to manufacturing tolerances permitted in the various components, that is the side-frame pedestal jaw and bearing adapter, and to the form of the connection for the bearing adapter, the journal end of the wheelset and the integral jaws of the side frame structure. U.S. Pat. No. 3,211,112 to Baker discloses an assembly to damp the relative lateral movement between the wheel and axle assembly, and the associated side frame. More specifically, a resilient means or member is provided between the top of the journal end of the wheel and axle assembly, and the associated side frame member to produce varying frictional forces for damping the relative movement between the assembly and the side frame. The Baker-'112 patent recognized the undesirability of transmitting track perturbations through the wheelset, side frames and bolsters, but inhibition of this force transmission is intended to be accomplished by damping the disturbances caused by the lateral axle movements, not by suppressing their initiation.

In U.S. Pat. No. 3,274,955 to Thomas and also in U.S. Pat. No. 3,276,395 to Heintzel, a roller bearing adapter is illustrated with an elastomer on the upper part of the cap plate, which adapter is positioned in the side frame pedestal jaw with the elastomer between the pedestal roof and the adapter for relieving exposure to high stresses. A similar concept is shown in U.S. Pat. No. 3,381,629 to Jones, which provided an elastomeric material between each bearing assembly and the pedestal roof to accommodate axial movements of the bearing assemblies of each axle and to alleviate lateral impact to the side frame.

Other means have been utilized for maintaining a truck in a square or parallel relationship. In U.S. Pat. No. 4,103,623-Radwill, friction shoes are provided to frictionally engage both the side frame column and bolster. This friction shoe arrangement is intended to increase the restraining moment, which is expected to result in an increased truck hunting speed. The friction shoes had contact surfaces with some appropriate manufacturing tolerance to control initial contact areas to develop a maximum restraining moment.

U.S. Pat. No. 4,192,240 to Korpics provided a wear liner against the roof of a side-frame pedestal jaw. The disclosure recognized the detrimental effects of having a loose wear liner in the pedestal jaw. Wear liners are provided against the roof of the pedestal jaw to reduce wear in the roof caused by oscillating motions of the side frame relative to the wheel-axle assembly and the bearing. The disclosed wear liner included upwardly projecting tabs to grip the roof and side frame to inhibit longitudinal movement of the wear liner, and downwardly projecting legs to cooperate with the pedestal-jaw stop lugs to inhibit lateral movement of the wear liner relative to the roof. The stop lugs of the pedestal jaw are positioned on opposite sides of the depending legs of the jaw, which lugs are engageable with the downwardly depending wear liner legs.

U.S. Pat. No. 3,621,792 to Lisch provides a pedestal jaw opening with outwardly sloped sidewalls and a bearing adapter with sloped sidewalls positioned in the jaw opening. An elastomeric is positioned between the adapter and the pedestal sidewall and roof, which elastomer provides resistance in compression and yieldability in shear, and sufficient softness for cushioning. It is noted that by positioning the elastomeric pad between all the interfaces of the adapter and the pedestal jaw, metal-to-metal contact is prevented along with wear and transmission of noise and vibration from the track to the truck framing. Similarly in U.S. Pat. Nos. 3,699,897 and 4,416,203 to Sherrick, a resilient pad is provided between the bearing adapter and the side frame.

In U.S. Pat. No. 4,072,112 to Wiebe, an elastomeric positioning means is placed intermediate the bearing carrier and one of the pedestal jaws to bias the bearing carrier into direct communication or engagement with the opposite pedestal jaw to limit relative angular movement and linear displacement of the wheel set to the side frame.

U.S. Pat. No. 4,108,080 and 4,030,424 to Garner et al. teach a rigid H-frame truck assembly having resilient journal pads in the pedestal jaws. The truck provided by this development demonstrated improved riding characteristics. Similarly U.S. Pat. Nos. 4,082,043 and 4,103,624 to Hammonds et al. disclose an integral H-frame truck with resilient elements in the journal bearings.

In U.S. Pat. No. 4,242,966 to Holt et al., a railcar truck has a transom with a pair of tubes rigidly connected between the longitudinally extending side frames. The transom allows vertical movement of the side frames but resists longitudinal displacement of the side frames with respect to each other.

U.S. Pat. No. 4,841,875 to Corsten et al. provides a suspension arrangement with at least two annular elastomeric shock absorbers having an optimum adjustability in the longitudinal and transverse directions of the vehicle.

Alternative means for the insertion and securing of a wear liner against a pedestal jaw roof are taught in U.S. Pat. Nos. 4,034,681 and 4,078,501 to Neumann et al. and U.S. Pat. No. 4,192,240 to Korpics, which patents have a common assignee. The objective of these patent disclosures was to provide improved means for securing a wear liner in the jaw to minimize its movement and to improve the assembly means. The wear liners are provided with downwardly depending legs and stop lugs positioned to inhibit movement of the wear liner, such as in the lateral direction relative to the roof.

U.S. Pat. No. 4,428,303 to Tack illustrates a clip-on pedestal wear plate especially adapted for worn pedestal surfaces. A pair of wear plates, or a single member with a central portion of the plate removed, may be used to provide the structure of the invention.

All of the above disclosed apparatus disclose a journal assembly or an assembly for a railcar truck axle end, which assembly is operable in the pedestal jaw, and the disclosures recognized the desirability of keeping the truck side frames aligned with each other to avoid truck hunting. However, the several disclosures provided a plurality of resilient means or structures in the pedestal jaw and around the axle journal bearings, but none of the structures addressed the problem of maintaining the bearing adapter and consequently the axle and side frames in their aligned positions. Several of the abovenoted references specifically utilized elastomeric or resilient components in the pedestal jaw or in association with the journal bearing to accommodate the disturbances and flexing motions experienced by the axles and side frames.

SUMMARY OF THE INVENTION

A side frame for a railcar truck has pedestals at both of its longitudinal ends with jaws to receive the journal ends of the axle shafts. These journals are generally provided with bearings, which are secured in bearing adapters positioned in the pedestal jaws with the intent that the axles, usually two, of the truck remain aligned and parallel during railcar travel. The above-noted bearing adapters are generally secured in the pedestal jaw by mating a recess in the bearing adapter with thrust lugs protruding from the side frame pedestal, which are maintained in this interlocked mating by the railcar weight. In addition, wear plates are frequently positioned between the adapter and the pedestal jaw roof to minimize wear from the repeated flexing of the adapter in the jaw during railcar travel. The present invention provides a bearing adapter angularly secured against the roof of the side-frame pedestal jaw, which adapter accommodates the journal bearing on the axle end. The adapter is provided at an acute angle to both the horizontal and vertical side-frame axes to bear against the thrust lugs to more positively transfer the warping loads to the side frame to minimize the flexural displacement in the jaw and bearing to more narrowly limit the lateral displacement of the axle and side frame assemblies to reduce railcar truck warping and the consequent truck hunting. Such an integral jaw and bearing assembly increases warp resistance and reduces the angular displacement under moderate warping loads below 1° and in a preferred embodiment is less than 0.35°. It is recognized that truck hunting is not eliminated per se, but the increased resistance to warping results in reduced angles of lateral displacement. The consequent critical speed, where truck hunting occurs, is increased beyond the normal operating speed of the railcar. In an alternative embodiment, a wear plate is secured into the pedestal-jaw roof at a desired acute angle and the bearing adapter is secured in the pedestal jaw against the wear plate at the appropriate angle and against the thrust lugs to again minimize the frequency of vibration and to positively transfer the vibrational load to the side frame at a minimum warp angle between the axle and side frames.

BRIEF DESCRIPTION OF THE DRAWINGS

In the figures of the Drawing, like reference numerals identify like components and in the drawings:

FIG. 2 is an enlarged elevation view in partial cross-section of an exemplary prior art side-frame pedestal jaw having a wear plate, bearing adapter and axle end positioned therein;

FIG. 3 is a cross-sectional view along an axle longitudinal axis of a pedestal jaw with a wear plate, bearing adapter, an axle and a journal bearing positioned therein;

FIG. 4 is a side view of a pedestal jaw with a bearing adapter positioned in the jaw against the thrust lugs at an acute angle;

FIG. 4A is a plan view of the side frame and bearing adapter of FIG. 4;

DETAILED DESCRIPTION OF THE PREFERRED EMBODIMENT

Figure 1:
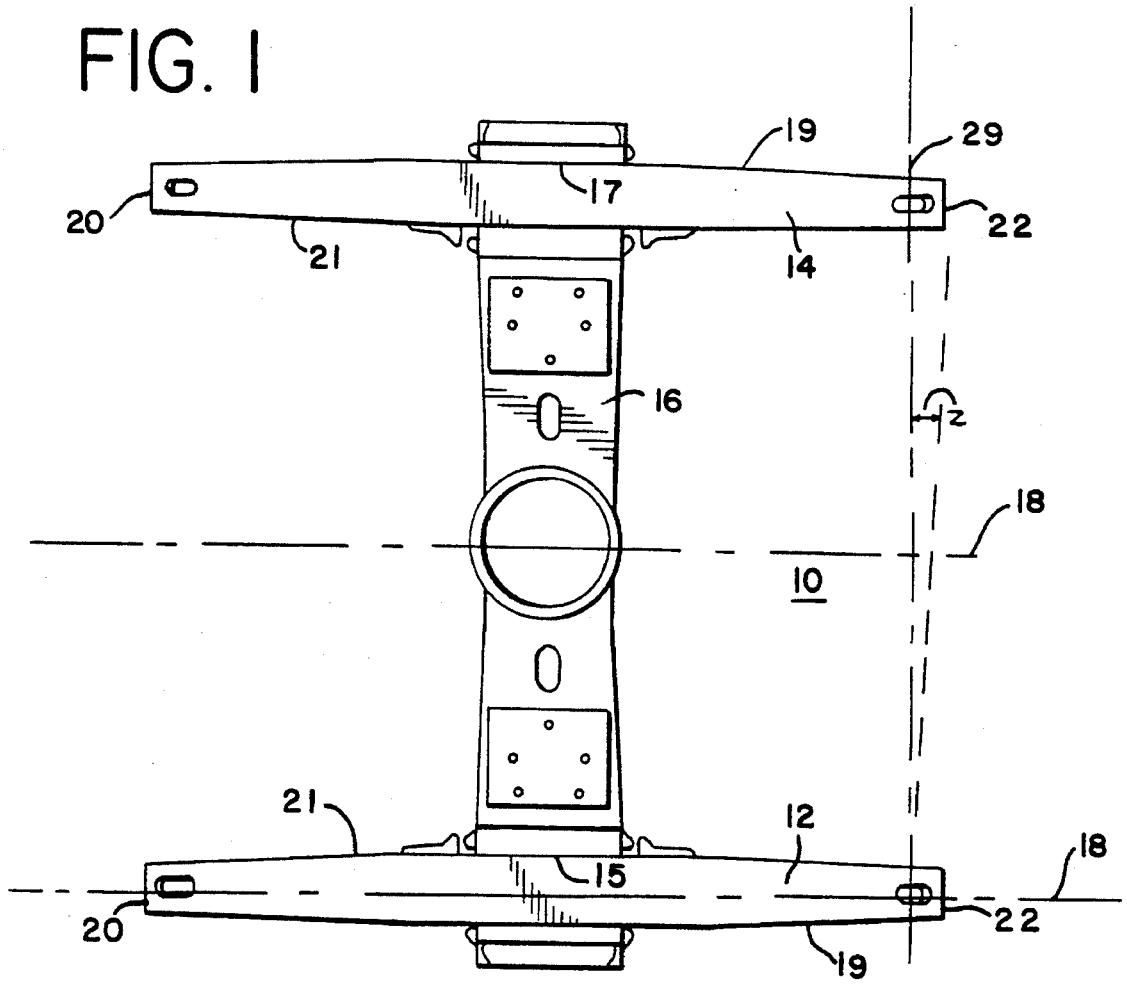
FIG. 1 is a plan view of an exemplary rail truck bolster and side frame assembly.
Figure 6:
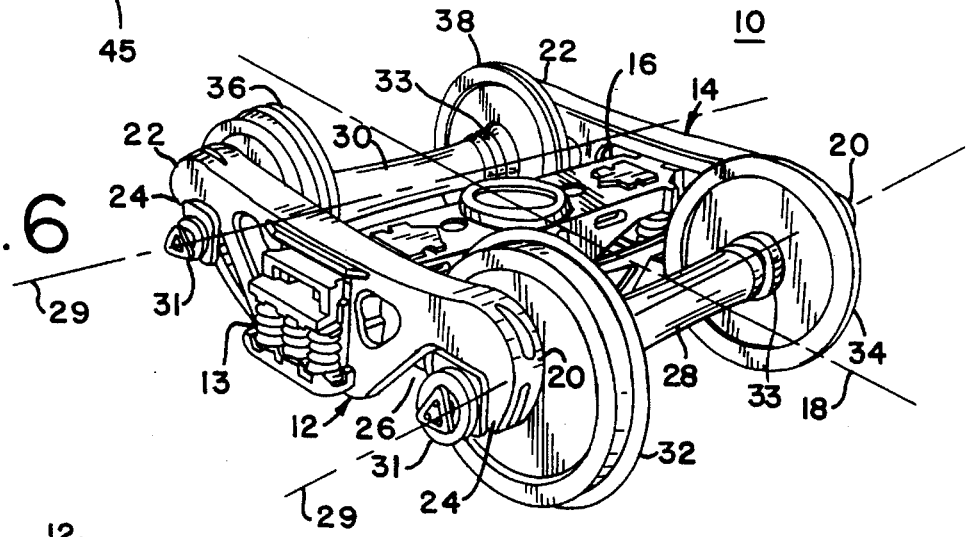
FIG. 6 is an oblique view of an exemplary railcar truck.

Railcar truck 10, as illustrated in FIGS. 1 and 6, is generally an assembly of three main components, that is first side frame 12, second side frame 14 and bolster 16 extending therebetween at about respective side-frame midpoints 15 and 17 of parallel side frames 12 and 14. Bolster 16 is about normal to each of side frames 12 and 14. Side frames 12 and 14 are generally parallel to longitudinal truck axis 18, which axis 18 may thus be considered as the longitudinal axis of side frames 12 and 14 (see FIG. 1). Side frames 12 and 14 include first end 20 and second end 22, which ends 20 and 22 each have a pedestal jaw 24 and bearing opening 26. As each of side-frame pedestal jaws 24 and bearing openings 26 are similar only one will be described, but the description will be applicable to each of openings 26 and pedestal jaws 24 of side frames 12 and 14.

Truck 10 is shown in FIG. 6 with first and second axles 28 and 30, each having first and second axle ends 31 and 33, respectively, with wheels 32, 34, 36 and 38 mounted on their respective axle ends 31, 33. Axles 28 and 30, which both have second longitudinal axes 29 about normal to first axis 18, are mounted at and extend between respective first and second side-frame ends 20 and 22 of side frames 12 and 14. The various ancillary elements of truck 10, such as spring pack 13 in FIG. 1A and friction shoes (not noted), are a part of a typical truck assembly 10.

In FIG. 1, a plan view of truck 10 notes the longitudinal and transverse relationship between side frames 12 and 14, and bolster 16. The elevation view of side frame 12 with wheels 32 and 36 in FIG. 1A demonstrates the relative longitudinal symmetry of side frame 12 or 14. As noted above, only one of pedestal jaws 24 is described, but the description will apply to any of pedestal jaws 24 of side frames 12 and 14. An axle 28 and bearing assembly 46, as shown in FIG. 2 and FIG. 6, is positionable in jaw opening 26, but is not shown in FIG. 1A. Typically axle end 31 or 33 with journal bearing 46 is secured against bearing adapter 48, which is positioned against pedestal-jaw roof 44 with wear liner 42 therebetween. Historically wear liner 42 has been utilized to minimize the effects of rubbing and flexing of adapter 48 against roof 44, which may result in wear and distortion of roof 44. However, the insertion of wear liner 42 also adds another component to the structure of axle end 31 and side frame 12, which introduces further structural tolerances to this axle-end assembly, and consequently more opportunity for lateral axle-frame displacement.

Figure 5:
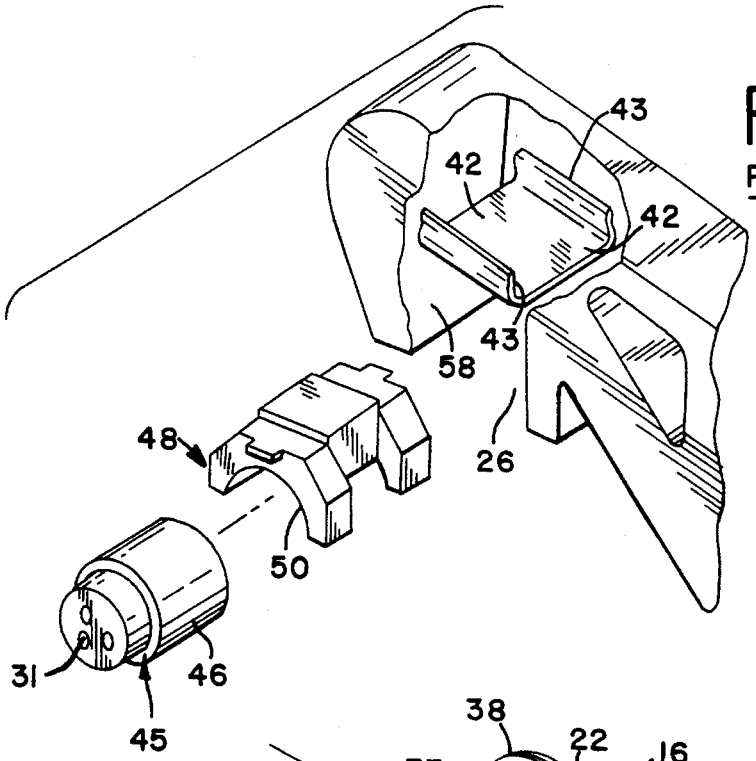
FIG. 5 PRIOR ART
FIG. 5 is an exploded oblique view of an exemplary prior art pedestal jaw, wear liner, locked bearing adapter and journal bearing assembly.

In FIGS. 2, 3 and 5, axle end 31 of axle shaft 28 is noted in a pedestal jaw structure. In FIG. 2, axle shaft end 31 extends through pedestal jaw 24 and opening 26 with wear liner 42 nested against jaw roof 44. Journal bearing or bearing outer race 46 is an annular bearing which is slidably fit onto axle-shaft end 31.

Figure 1A:
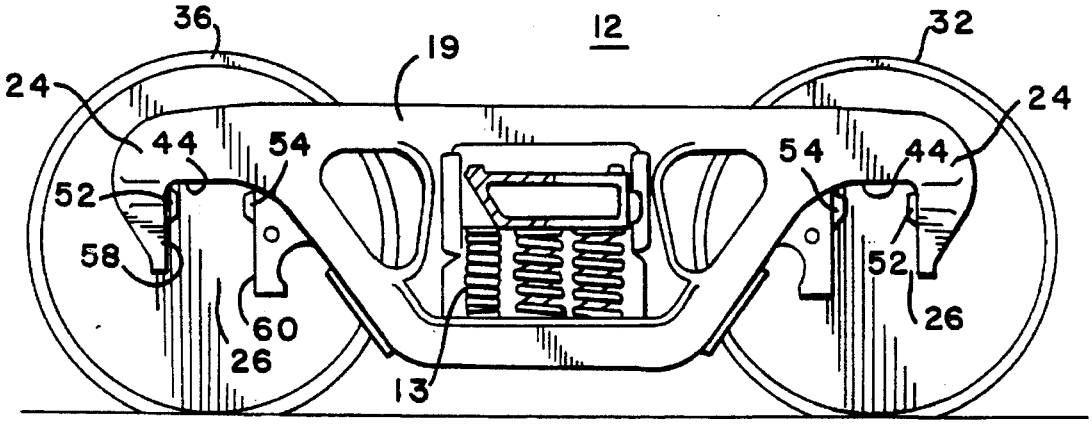
FIG. 1A is an elevation view of a side frame with its pedestal jaw outlined against rail wheels.
Figure 7:
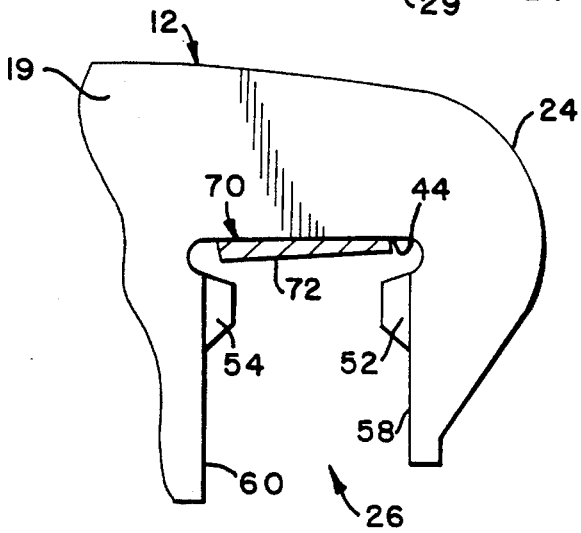
FIG. 7 is an enlarged side view of a pedestal jaw with a tapered wear liner positioned against the pedestal-jaw roof with the wear-liner taper in a longitudinal direction.

Bearing adapter 48 is secured against wear liner 42 between thrust lugs 52 and 54 of jaw 24, which lugs 52 and 54 extend into opening 26 and are more clearly illustrated in FIGS. 1A and 7. Axle end 31 and journal bearing assembly 46 with outer surface 56 are retained in jaw 24 and opening 26 against arcuate surface 50. In FIG. 2, the separation distance 'y' between outer surface 56 of journal bearing 46 and inner wall 58 of opening 26 is indicative of the clearances provided in the assembly of an axle end 31 or 33, pedestal jaw 24 and opening 26. This separation distance 'y' is acquired from the initial manufacturing process tolerances for the various parts of the assembly and is provided to assure adequate clearance for assembly of these parts.

A wear plate-adapter-bearing assembly, which is similar to the structure of FIG. 2, is shown in a longitudinal cross-section in FIG. 3 with roof 44 of pedestal jaw 24 grasped by clips 41 of wear liner 42. In this figure, first lip 49 and second lip 51 of adapter 48 extend, respectively, over outer edge 57 and inner edge 59 of outer surface 56 to retain bearing assembly 46 and axle 28 in position in jaw opening 26. The structure of FIG. 2 illustrates a previous attempt to control the wear and flexing of an axle and side frame by insertion of an elastomeric element 61 between wear plate 42 and upper surface 47 of adapter 48 to damp or accommodate the vertical forces transmitted between a wheel and side frame. Similarly in FIG. 5, the exploded view of axle end 31, journal bearing 46, bearing adapter 48 and wear liner 42 illustrates the plurality of parts in many present axle and side frame assemblies. These bearing-axle assemblies of FIG. 5 clearly demonstrate the accumulation of tolerances and clearances that provide gap distances, which add to the amplification or increase in flexing between an axle 28 or 30 and side frames 12, 14 during operation of truck 10, which flexing can consequently lead to the introduction of truck hunting.

In FIG. 4, horizontal roof 44 and generally vertical jaw side walls 58 and 60 (cf., FIG. 1A) have been, respectively, displaced at an acute angle 'x' from the horizontal (longitudinal truck) axis 18 and vertical axis 68 to receive adapter 48, which is shown with generally normal vertical and horizontal sides in this Figure. Adapter 48 is provided at an angle 'x' in pedestal-jaw opening 26 and it is biased toward one of stop lugs 53 and 55 on outside or outboard surface 19 of side frame 12. Pads 53 and 55 in FIG. 4A are provided on outboard surface 19 and inboard surface 21, respectively, of side frame 12 to maintain adapter 48 aligned and square with respect to pedestal jaw 24.

In the above-described embodiment of FIGS. 4 and 4A, the present invention avoids the earlier described use of a wear liner 42, thereby removing the manufacturing and assembly tolerances associated with a wear liner. In this structure, bearing adapter 48 is more nearly an integral part of side frame 12 as it has been mated to roof 44, although angularly displaced from the respective horizontal and vertical axes 18 and 68 of side frame 12. In this configuration, axle 28, and more specifically journal bearing 46, is securely nested against bearing adapter surface 50 and, in cooperation with tightly mated bearing adapter 48, provides a more secure mating between axle 28 and side frames 12 and 14 to inhibit lateral displacement of axle 28 and side frames 12 and 14, which consequently inhibits or minimizes truck hunting.

The above-noted angular displacement is most easily referenced from side-frame longitudinal axis 18 and longitudinal second axis 29 axles 28 or 30, which axes 18 and 29 are generally normal and intersecting. As illustrated in FIG. 1, the intersection of axes 18 and 29 defines a generally horizontal plane. Angular displacement, 'z' in FIG. 1, between the axle and side frame is the displacement of second axis 29 from the intersection point of the axes and its normal position to axis 18. This angular displacement may be in either a forward or rearward direction in the horizontal plane, or alternatively the noted angular displacement may be considered as displacement of axis 18 relative to second axis 29. In either case, it is this small angular displacement, 'z', which is referenced as lateral displacement.

The combination of integrally mated side frame 12 and bearing adapter 48, as well as the displacement of bearing adapter 48 at a small angular displacement from horizontal and vertical axes 18 and 68, provides the greatest improvement to the inhibition of lateral displacement of axle 28 relative to side frame 12 to minimize truck warping, which thus inhibits truck hunting. This angular offset of bearing adapter 48 from horizontal axis 18 and vertical axis 68 disposes it to transfer the warping load or forces to outer stop lug 53 or 55. It has been found that such load transfer provides truck 10 with improved operating characteristics against truck hunting.

In an alternative embodiment shown in FIG. 7, angular displacement of bearing adapter 48 in opening 26 can be accommodated with a modified arrangement of wear liner 42 and bearing adapter 48. In this arrangement, wedge-shaped wear liner 70 is secured to roof 44 and has its tapered or wedge-shaped alignment in the longitudinal direction of side frame 12. As illustrated, all of tapered surface 72 of wedge-shaped wear liner 70 extends into opening 26 from roof 44. As shown in FIG. 4, upper surface 47 of bearing adapter 48 is flat and generally normal to adapter front edge 76 and rear edge 78. Therefore, mounting of adapter 48 in opening 26 with wedge-shaped wear liner 70 positioned against roof 44 will angularly displace adapter 48 in opening 26. This angular displacement at roof 44 provides adapter 48 at an angle in opening 26 and consequently will place an angular load or bias against one of outside stop lugs 53 and 55. The longitudinal direction of tapered surface 72, that is front-to-back or back-to-front, is not determinative of the improvement in the lateral (angular) displacement between axle 28 and side frame 12.

Indicative of the improvement of the angular displacement, the angular displacement of axle 28 has been reduced from 1° to less than 0.35° of angular displacement with the present invention. As noted above in earlier research work, decreasing the angular displacement results in improved truck hunting, or more accurately has been noted to increase the critical speed where truck hunting commences.

While only a specific embodiment of the invention has been described and shown, it is apparent to those skilled in the art that various alternatives and modifications can be made thereto. It is, therefore, the intention in the appended claims to cover all such modifications and alternatives as may fall within the true scope of the invention.

We claim:

1. In a railway truck assembly having a first side frame and a second side frame generally parallel to each other, and a bolster transverse to said parallel side frames, each said first and second side frame having a first longitudinal axis, an upper surface, a lower surface, a first end, a second end and a longitudinal midpoint generally between said first and second ends, said transverse bolster connecting said first and second side frames at about said respective side-frame midpoints, a plurality of bearing assemblies, a first axle and a second axle, each said first and second axle extending between opposed ends of said first and second side frames and, generally parallel to each other and transverse to said first longitudinal axis, each said first and second axle having a second longitudinal axis, a first axle-end and a second axle-end, each said axle end having a bearing assembly thereon, said first and second longitudinal axes approximately normal to each other, which first and second axes intersect and cooperate to define a horizontal plane, a vertical plane at each said axle, which vertical plane is normal to said horizontal plane and includes said second longitudinal axis, each said side-frame end having a pedestal with an integrally formed, downwardly open jaw to receive a mated axle-end and bearing assembly, which jaw includes a roof, a first depending leg with a first sidewall and a second depending leg with a second sidewall, said first sidewall about parallel to said second sidewall, said first and second sidewalls extending from said roof, said roof, first sidewall and second sidewall cooperating to define a cavity open at said lower surface to receive a bearing adapter and axle end, said roof generally parallel to said horizontal plane and said first and second sidewalls generally perpendicular to said roof at a reference condition, said first and second legs having substantially opposed thrust lugs protuding from said sidewalls into said cavity, a plurality of bearing adapters, a bearing adapter positioned in each said pedestal jaw, said bearing adapter and pedestal jaw meeting at an interface, said interface comprising:

a first stop lug on said side-frame outboard surface and a second stop lug on said side-frame inboard surface at each said pedestal jaw opening, each said stop lug positioned in proximity to said respective pedestal-jaw roof;

each said pedestal jaw roof, said first depending leg sidewall and said second depending leg sidewall rotationally displaced at an acute angular arc distance about said second longitudinal axis to provide said jaw roof at a first acute angle to said horizontal plane, and said first and second depending leg sidewalls displaced in a direction toward one of said first and second side frame ends from said vertical plane at said acute angle; and said bearing adapter having an upper wall, a first outer wall, a second outer wall, and an arcuate lower wall, said first and second outer walls generally perpendicular to said upper wall, said bearing adapter positioned and secured in said pedestal jaw opening with said upper wall secured against said jaw roof and, said first and second outer walls secured between said first and second depending-leg sidewalls at said acute angle to receive an axle end and bearing assembly for retention in said pedestal jaw in said acutely angled adapter at said arcuate lower wall to provide lateral displacement loads from said axles against said stop lugs to inhibit lateral displacement between said axle and said side frame to less than one-half degree of angular displacement for inhibition of truck warping and hunting.

2. In a three-piece railway truck assembly as claimed in claim 1, said pedestal jaw further comprising a first thrust lug and a second thrust lug, one of said first and second thrust lugs extending from one of said first and second depending-leg sidewalls and the other of said first and second thrust lugs extending from the other of said first and second depending-leg sidewalls into said cavity, said bearing adapter first outer wall defining a first slot, and said second outer wall defining a second slot, each said slot matable with one of said first and second thrust lugs to secure said bearing adapter in its longitudinal position in said cavity.

3. In a three-piece railway truck assembly as claimed in claim 1 wherein said bearing assemblies and axles are secured in said acutely angled bearing adapters at said side frames and axle ends to limit angular displacement to less than 25 minutes of postassembly angular deflection between said axle and side frame axes during truck traverse of rail tracks.

4. In a three-piece railway truck assembly as claimed in claim 1 wherein said side-frame, acutely-angled pedestal jaw is a single cast structure and said jaw and cavity are provided in said structure by one of forming, casting and machining.

5. A three-piece railway truck assembly having a first side frame and a second side frame generally parallel to each other, and a bolster transverse to said parallel first and second side frames, each said first and second side frame having a first longitudinal axis, an outboard side, an inboard side, an upper surface, a lower surface, a first end, a second end and a longitudinal midpoint generally midway between said first and second side-frame ends, said transverse bolster connecting said first and second side frames at about their midpoints, a plurality of bearing assemblies, a first axle and a second axle generally parallel to each other and transverse to said first longitudinal axis, each said first and second axle having a second longitudinal axis, a first axle-end and a second axle-end, each said first and second axleend having a bearing assembly thereon, said first and second longitudinal axes normal to each other, which first and second longitudinal axes intersect and cooperate to define a horizontal plane, a vertical plane at each said axle, which vertical plane is normal to said horizontal plane and includes said second longitudinal axis, each said side-frame end having a pedestal with an integrally formed downwardly open jaw to receive an axle-end and bearing assembly, which jaw includes a roof approximately parallel to said horizontal plane, a first depending leg with a first sidewall and a second depending leg with a second sidewall, which first and second sidewalls are approximately parallel to said vertical plane, said pedestal-jaw roof, first sidewall and second sidewall cooperating to define a cavity which is open at said lower surface, a plurality of bearing adapters, one of said bearing adapters positioned in each said cavity, means for rotationally displacing said bearing adapters in said pedestal jaw, said means comprising:

a plurality of tapered wedges, each said wedge having a first and wider end and a second and narrow end, each said wedge tapered from said wider end to said narrow end and secured against said roof with said taper provided in the longitudinal direction of said side frame, a first stop lug and a second stop lug, one of said stop lugs mounted on said side-frame outboard surface and the other of said stop lugs mounted on said side-frame inboard surface, both said stop lugs in proximity to said roof, each said bearing adapter having an upper wall, a first outer wall and a second outer wall, said first and second outer alls generally perpendicular to said upper wall, a bearing adapter mounted in each said pedestal-jaw cavity and extending beyond said cavity at said inboard and outboard surface to contact said first and second stop lugs, each said bearing adapter mounted in each said pedestal jaw operable to receive an axle-end and bearing assembly, said adapter in said jaw secured against said wedge at said adapter upper wall to displace said adapter upper wall at a first acute angle to said horizontal plane, and to rotate said first and second adapter sidewalls from said vertical plane at said acute angle to receive an axle end and bearing assembly for retention in said pedestal jaw in said acutely angled bearing adapter to provide lateral displacement loads from said axles against said stop lugs to inhibit lateral displacement to less than one-half degree of angular displacement for inhibition of truck warping and hunting.

6. In a three-piece railway truck assembly as claimed in claim 5, said pedestal jaw further comprising a first thrust lug and a second thrust lug, one of said first and second thrust lugs extending from one of said first and second depending-leg sidewalls and the other of said first and second thrust lugs extending from the other of said first and second depending-leg sidewalls into said cavity, said bearing adapter first outer wall defining a first slot, and said second outer wall defining a second slot, each said slot matable with one of said first and second thrust lugs to secure said bearing adapter in its longitudinal position in said cavity.

7. In a side frame bearing assembly as claimed in claim 6, wherein one of said components positioned and secured in each said bearing adapter against said roof with said narrow and wider ends generally aligned along said side frame longitudinal axis; said pedestal legs having thrust lugs on said legs inwardly directed toward said jaw and lands both inboard and outboard of said thrust lugs on either side of said thrust lugs, a bearing adapter secured in said jaw against said thrust lugs, and wedge to secure said adapter in position at an acute angle vertically displaced from first longitudinal axis and operable to provide a locking force against rotational motion of said adapter, bearing assembly and axle secured in said bearing adapter.

8. A railway truck side-frame pedestal jaw arrangement, said railway truck having a truck longitudinal axis, a first side frame, a second side frame and a bolster, each said first and second side frame having a first longitudinal axis, an upper surface, a lower surface, an outboard surface, an inboard surface, a first end, a second end, a longitudinal midpoint between said first and second side-frame ends and, a pedestal jaw at each said side frame first and second end, said railway truck having at least one axle, each said axle having an axle axis generally transverse to said truck longitudinal axis, a first axle end and a second axle end, each said end mountable in a pedestal jaw, a plurality of bearing assemblies, one of said bearing assemblies mountable on each said axle end, a plurality of bearing adapters, one of said bearing adapters mountable in each said pedestal jaw, said bearing assembly and axle end mountable in said pedestal jaw against said adapter for retention in said pedestal jaw, each said pedestal jaw comprising:

a pedestal-jaw roof portion, a first side wall portion and a second side wall portion cooperating to define a pedestal jaw cavity, said cavity open at said lower surface, said side-frame inboard surface having at least one stop lug positioned in proximity to said jaw opening, said side-frame outboard surface having at least one stop lug positioned in proximity to said jaw opening, which inboard and outboard stop lugs are substantially aligned;

said side-frame longitudinal axis and said axle axis intersecting and being about normal, said axes cooperating to define a horizontal plane;

said roof portion at a reference position approximately parallel to said side-frame longitudinal axis and said horizontal plane, said pedestal-jaw first and second side walls approximately normal to said roof portion;

each said bearing adapter having at least an upper surface to contact said roof portion, a first side leg and a second side leg to locate said bearing adapter in said jaw opening;

said pedestal-jaw opening rotationally displaced about said axle axis to provide said roof portion, said first side wall portion and said second side wall portion at an acute angle of displacement to said horizontal plane; and, said bearing adapter positionable in said angled opening to provide said upper surface and side legs at said acute angle to said horizontal plane from said reference position and operable to receive said axle for transfer of lateral forces from said axle to said stop lugs to inhibit lateral displacement of said side frame and axle to less than one-half degree of angular displacement.

9. A railway truck, side-frame pedestal jaw arrangement as claimed in claim 8 further comprising a first thrust lug on said cavity first side-wall and a second thrust lug on said cavity second side-wall, said first and second thrust lugs juxtaposed in said jaw opening; and, said bearing adapter first side leg having a first notch and said second side leg having a second notch, one of said first and second notches matable with one of said first and second thrust lugs in said jaw opening and the other of said first and second notches matable with the other of said first and second thrust lugs, said thrust lugs operable to maintain said bearing adapter in position in said jaw opening and to transfer said lateral forces between said axle and side frame.

* * * * *